United States Patent [19]

Naka

[11] 3,999,627

[45] Dec. 28, 1976

[54] EMERGENCY ESCAPE

[76] Inventor: Hiromitsu Naka, 39, Oaza Shinmachi, Yashio, Saitama, Japan

[22] Filed: Oct. 15, 1975

[21] Appl. No.: 622,728

[30] Foreign Application Priority Data

Sept. 23, 1975 Japan ..... 50-114269

[52] U.S. Cl. ..... 182/18; 182/19; 182/78; 182/81; 182/100

[51] Int. Cl.[2] ..... E06C 9/10; E06C 1/383

[58] Field of Search ..... 182/78, 79, 81, 80, 182/100, 189, 19, 208, 18

[56] References Cited

UNITED STATES PATENTS

| | | | |
|---|---|---|---|
| 377,953 | 2/1888 | Mills | 182/189 |
| 431,955 | 7/1890 | Schnieder | 182/189 |
| 876,354 | 1/1908 | Houghton | 182/81 |
| 1,192,615 | 7/1916 | Frey | 182/100 |
| 2,101,053 | 12/1937 | Santina | 182/85 |
| 2,965,193 | 12/1960 | Murphy | 182/100 |
| 3,485,322 | 12/1969 | Trefz | 182/189 |
| 3,894,614 | 7/1975 | Naka | 182/100 |

*Primary Examiner*—Reinaldo P. Machado
*Attorney, Agent, or Firm*—Wenderoth, Lind & Ponack

[57] ABSTRACT

An emergency escape comprises a stowage framework to be anchored in an opening formed in the slab of the floor of a room or the veranda, upper and lower covers interlocked linkage means, an escape means including a plurality of telescopically connected pipe sections, each of the pipe sections having a rung at the lower end on the uppermost pipe section being rotatably supported in the framework, and descent control means.

The descent and extension speed of the escape means is controlled by the descent control means when the descent control means released a ratchet mechanism.

14 Claims, 40 Drawing Figures

Fig. 5A
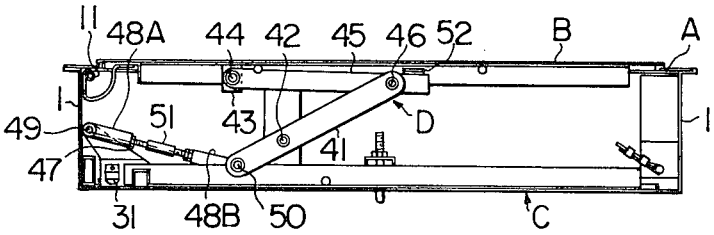
Fig. 5B
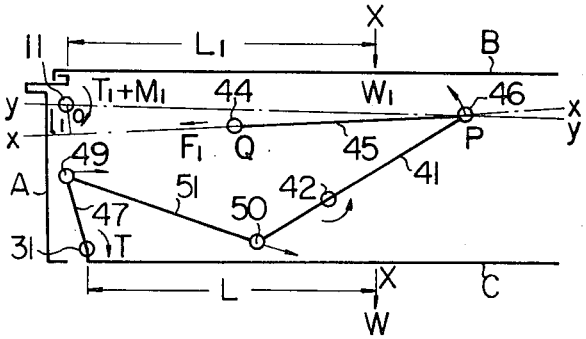
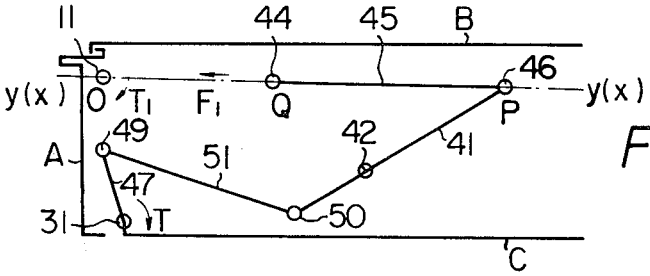
Fig. 5C
Fig. 5D
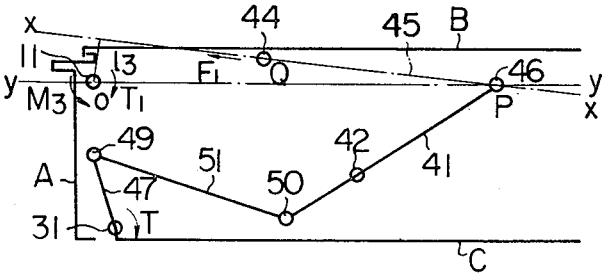

Fig. 8C
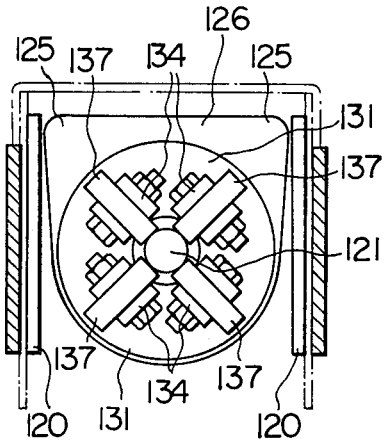
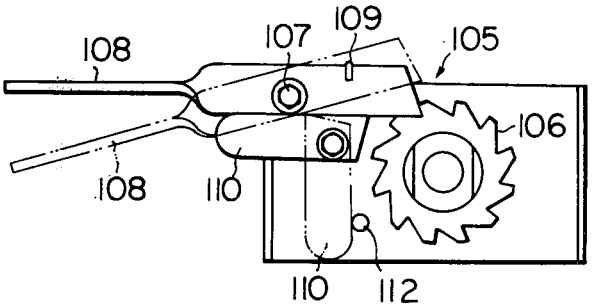
Fig. 8D
Fig. 8E
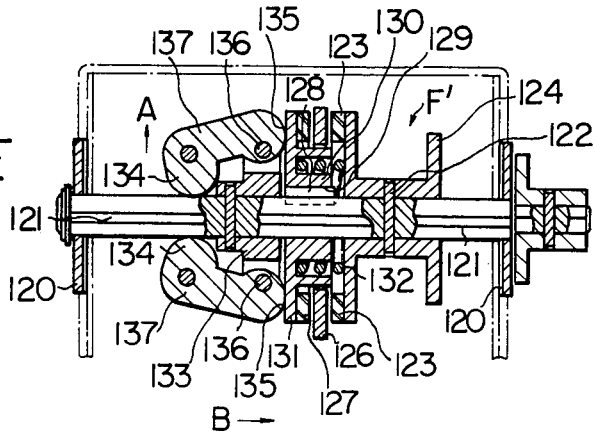

EMERGENCY ESCAPE

This invention relates to an emergency escape adapted to be housed in an opening formed in the floor of a room of a multi-storey building or the veranda of an apartment house when the escape is noted used and extend downwardly when any emergency occurs in the building or apartment house whereby the occupants in a storey of the building or apartment house can safely evacuate to a safer storey below the storey in which such emergency occured or a safer location on the ground outside of the building or apartment house.

There have been proposed and practically employed a great variety of emergency escapes for use in multi-storey buildings. One of the most commonly employed escapes is in the form of a rope ladder which is adapted to be storaged in its folded condition in an opening formed in the floor of a room of a multi-storey building or the veranda of an apartment house when the rope ladder is not used and when the ladder is employed, the ladder is extended out of the opening. However, when the rope ladder is extended for its intended purpose, the ladder usually sways by a great extent and when the user descends down the ladder, the ladder inclines in one direction or toward the side opposite from the user on one side of the ladder to a degree that the user encounters difficulties in descending down the ladder. In addition, since the rope ladder is usually installed close to a wall of a building and the rungs of the ladder are provided with strut legs extending substantially horizontally at right angles to the rungs to abut against the wall so as to keep the ladder away from the wall, the rope ladder is required to be used to maintain a space between the wall and the rungs of the ladder corresponding to the length of the strut legs. Thus, the application of the rope ladder is limited to a narrow range of areas.

Furthermore, since the conventional emergency escapes including the above-mentioned rope ladder are designed to be storaged in a merely folded condition in an opening formed in the floor of a storey of a building or the stowage framework held in such an opening and the escapes are also designated to be allowed to extend downwardly by gravity when the cover or covers of the framework is opened, prior to the use of the escapes, it is not possible to ascertain whether the conditions in the storey or other evacuation areas to which the user evacuate are safe for the use of the escapes to thereby give anxiety to the user and/or leave potential hazards there.

Thus, one object of the present invention is to provide an emergency escape for use in a building which operates positively in case of emergency, which enables the user to evacuate safely, positively and rapidly and which will not strike the user with terror.

Another object of the present invention is to provide an emergency escape for a building which comprises an escape means which is not required to be secured at the lower end, but is substantially free of sway and which can be used at any desired location such as within a room or on a veranda.

Another object of the present invention is to provide an emergency escape for a building onto which the user can easily transfer to another emergency escape.

Another object of the present invention is to provide an emergency escape which comprises an escape means the descent or extension speed of which can be controlled as desired.

For attaining the above-mentioned objects, the emergency escape of the invention comprises an escape means comprising a plurality of pipe sections telescopically connected together and having different cross-section areas. The escape means is adapted to be storaged in a retracted condition in a stowage framework held in an opening formed in a building when not used and when used, the pipe sections of the escape means are allowed to telescopically extend and held in position by the engagement between the pipe sections.

Furthermore, in the emergency escape of the present invention, upper and lower covers are pivoted to the stowage framework and operatively connected to each other by means of at least one linkage means in such a manner that when the upper cover is opened or closed the lower cover is simultaneously opened or closed and when opened, the upper cover extends substantially uprightly and the lower cover depends substantially vertically and held in position whereby the upper end of the escape means is prevented from protruding above the surface of the floor in which the escape is to be installed. In order that the user can easily transfer to the escape means and from the escape means to the floor of a room of a multi-storey building or the veranda of an apartment house, the upper cover is provided with a handle and footholds.

In the emergency escape of the present invention, there is provided descent control means in combination with the escape means and the descent control means acts to control the initiation of the extending descent of the escape means and the descent speed of the escape means and retract the extended escape means to the stowage position within the stowage framework.

The above and other objects and attendant advanges of the present invention will be more apparent to those skilled in the art from a reading of the following detailed description in conjunction with the accompanying drawings which show some embodiments of the invention for illustration purpose only, but not for limiting the scope of the same in any way.

FIG. 5A is a fragmentary side elevational view in longitudinal section showing a preferred form of linkage means provided between said upper and lower covers for operatively connecting the covers to each other in an interlocking relationship;

FIGS. 5B through 5D are diagramatic views showing said linkage means in various operative positions;

FIG. 8C is an end elevational view of FIG. 8B;

FIGS. 8D and 8E are fragmentary diagramatic and longitudinal sectional views of the descent control means of FIG. 8B, respectively;

Figure 1A:
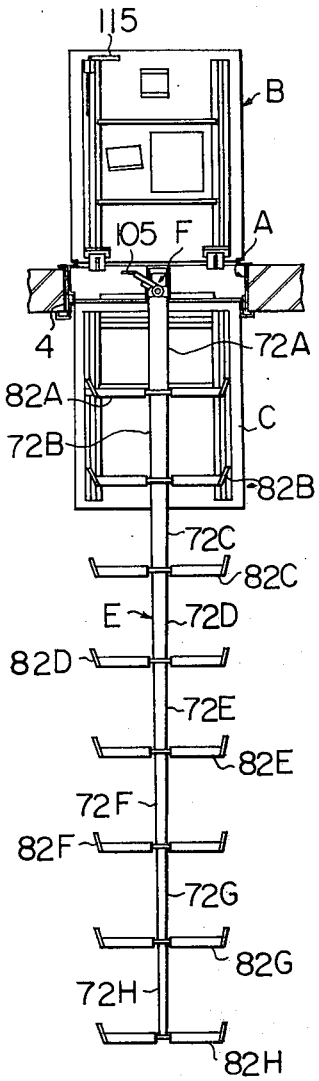
FIG. 1A is a front elevational view of one preferred embodiment of extensible emergency escape constructed in accordance with the present invention showing the escape in its operative or extended condition.

The present invention will be now described referring to the accompanying drawings and more particularly, to FIGS. 1A through 1D which show the first embodiment of extensible emergency escape of the invention in its operative or extended and non-operative or collapsed positions, respectively. In the collapsed position, the entire escape means of the escape is received within a stowage framework A which is in turn fitted and anchored in an opening 4 formed in the floor slab of a room or veranda in a multi-storey building (not shown).

The framework A includes an upper cover B pivoted to the floor side of the opening 4, a lower cover C pivoted to the ceiling side of the opening 4 and a pair of linkage means D which extend and interlock between the upper and lower covers B and C on the opposite sides of the covers in such a manner that when the upper cover B is manually opened or closed, the lower cover C is automatically opened or closed. In the collapsed position of the escape means, the upper and lower covers B and C extend horizontally and parallel to each other and in the released or extended position of the escape means, the upper cover B extends uprightly and held in position while the lower cover C suspends downwardly. One of the linkage means D connects between the upper and lower covers on the same one side of the covers while the other linkage means connects between the upper and lower covers on the other or opposite side of the covers, respectively.

The escape means E is in the form of an extensible ladder and includes eight telescopically connected pipe sections 72A, 72B . . . 72H of different cross-section areas which successively decrease downwardly with the uppermost pipe section 72A having the largest cross-section area and the lowermost pipe section having the smallest cross-section area. The pipe sections 72A, 72B . . . 72H have their respectively associated rungs 82A, 82B . . . 82H at the lower ends extending transversely of the associated pipe sections at right angles to the pipe sections, respectively. The uppermost pipe section 72A is rotatably supported in the framework A by means of a transverse stub shaft 85 which is in turn supported by the framework A and thus, when extended, the entire escape means E is suspended from the framework A.

Thus, it will be noted that when it is desired to use the escape, the upper cover B is manually pivoted from the horizontal position to the upright position to cause the lower cover C to simultaneously pivot from the horizontal position to the suspending position through the linkage means D whereupon the uppermost pipe section 72A rotates about the shaft 85 in one direction and the pipe section assembly is allowed to extend downwardly by gravity and on the other hand, when it is desired to collapse the escape means E, the successive lower pipe sections are telescoped into the respectively adjacent upper pipe sections and the uppermost pipe section 72A is rotated about the shaft 85 in the other or opposite direction. Thereafter, the lower cover C is pivoted back to the horizontal position to house the escape means E within the framework A in the horizontal position. The pivotal movement of the lower cover C to the horizontal position pivots the upper cover B back to the horizontal position through the linkage means D.

Descent control means F is provided at the upper end of the escape means E and the descent control means F is actuated only after it has been ascertained that no person is present in the underlying storey. When actuated, the descent control means F releases a ratchet mechanism 105 to allow the pipe sections to telescopically extend at a speed controlled by the descent control means F. The descent control means F includes a wire rope 113 which is adapted to hoiste to telescopically collapse the pipe sections 72A, 72B . . . 72H to the stowage position.

Figure 1B:
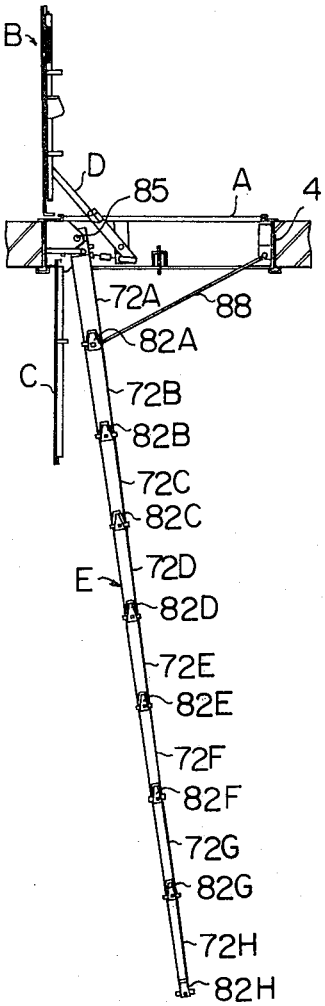
FIG. 1B is a side elevational view of said escape as shown in FIG. 1A.
Figure 1C:
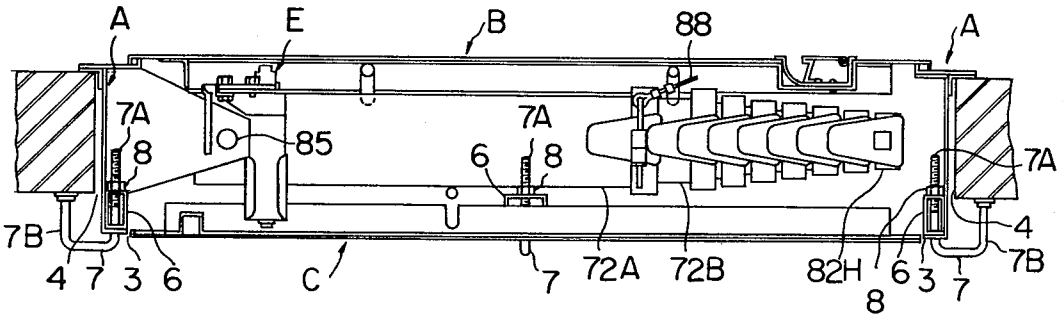
FIG. 1C is a longitudinal sectional view of said escape as shown in FIG. 1A showing the escape in its non-operative or collapsed condition.
Figure 2A:
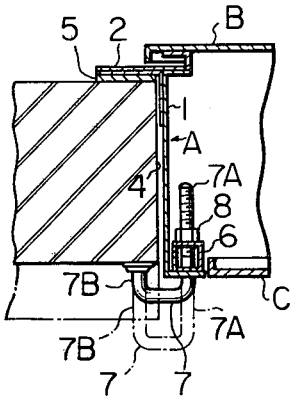
FIG. 2A is a fragmentary sectional view on an enlarged scale of the stowage framework of said escape as shown in FIG. 1A showing the framework in its anchored position with the escape means removed therefrom.
Figure 2B:
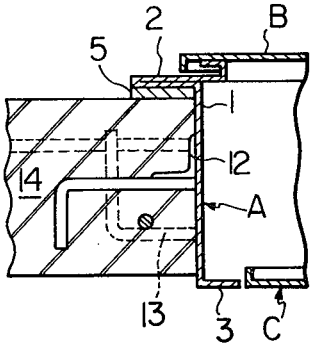
FIG. 2B is similar to FIG. 2A, but shows a modification of the stowage framework anchoring arrangement of FIG. 2A.

FIGS. 2A and 2B show details of the framework A of the extensible emergency escape as shown in FIGS. 1A and 1B and the manner by which the framework is anchored to the associated slab. The framework A includes four upright side wall members 1 connected together to form a square configuration and the side wall members each has at the upper end an upper bent edge 2 extending horizontally and outwardly of the associated upright side wall member and at the lower end a lower bent edge 3 extending horizontally and inwardly of the associated upright side wall member.

When positioned in the opening 4 formed in the associated slab, the upper edge 2 rests on the area of the slab defining the upper edge of the opening 4 whereby the framework A is suspended in the opening 4. An annular seal 5 is, of course, interposed between the upper edges 2 of the side wall members 1 and the slab areas defining the opening 4.

A U-shaped anchor rod 7 is provided below each of the lower bent edges 3 of the side wall members 1 with one longer threaded arm 7A extending through the associated lower edge 3 and a spacer 6 positioned on the upper surface of the lower edge 3 and the other shorter arm 7B abutting against the slab area defining the opening 4 on the ceiling side of the lower storey. The U-shaped anchoring rod 7 is held in position by means of a nut threaded on the longer threaded arm 7A.

The length of the arm 7A extending within the framework A can be varied depending upon the thickness of the associated slab whereby the framework A can be easily anchored to the slab. By selecting a suitable spacer 6, the framework A can be also suitably anchored to the slab. Although not shown, it is also possible that the other arm 7B of the U-shaped engaging piece 7 is previously embedded in the area of the slab defining the opening 4 prior to the anchoring of the framework A to the slab area and the one arm 7A is then inserted through the lower edge 3 of the associated side wall member 1 and spacer 6 followed by the tightening of the nut 8 onto the threaded arm 7A.

When the nut 8 is tightened onto the arm 7A of the U-shaped anchoring rod 7, since the stowage framework A is pulled downwardly or toward the ceiling of the underlying adjacent lower storey, the airtightness between the upper bent edges 2 of the framework A and the floor surface of the upper storey provided by the seal 5 is further increased. And by moving the arms 7A and 7B upwardly or downwardly, the framework A can be suitably anchored to slabs having different thicknesses.

The stowage framework A may be anchored to the associated slab by means other than the U-shaped anchoring rods 7 of FIG. 2A. Such alternative anchoring means is shown in FIG. 2B in which the parts corresponding to those shown in FIG. 2A bear the same numerals, respectively. Referring now to FIG. 2A, the alternative anchoring means is in the form of an angle 12. When the framework A is anchored to the slab by the use of a plurality of angles 12, during the finishing stage of a veranda or floor in the construction of a building, the angles 12 are secured by one arm thereof to the outer surfaces of the side wall members 1 which form the stowage framework A by means of welding or the like and the other arms of the angles 12 are then welded to reinforcing steel bars 13 partially embedded in the base of the veranda or floor. Thereafter, mortar, concrete or the like filler 14 is placed into the veranda base surrounding the framework A, angles 12 and reinforcing steel bars 13.

Figure 3A:
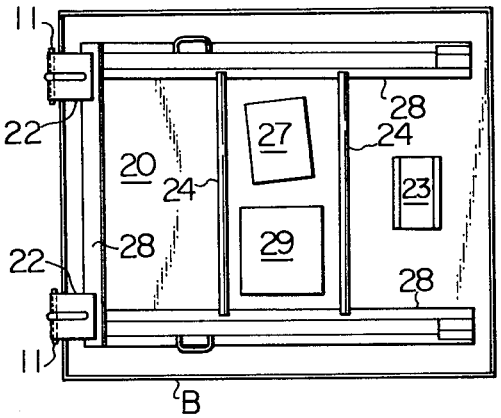
FIG. 3A is a reverse side view on an enlarged scale of a preferred form of upper cover for use in connection with said stowage framework of FIG. 2A.
Figure 3B:
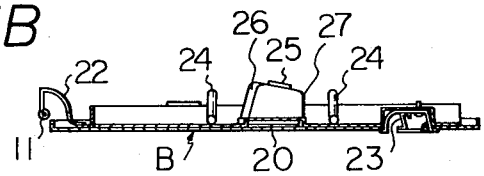
FIG. 3B is a side elevational view in longitudinal section of said upper cover of FIG. 3A.
Figure 3C:
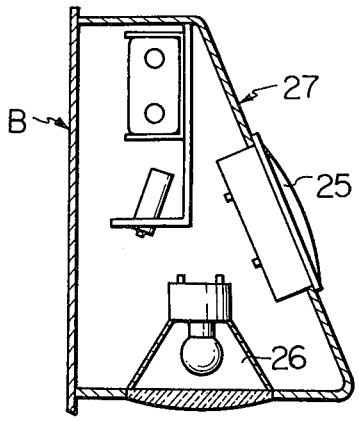
FIG. 3C is a fragmentary cross-sectional view on an enlarged scale of the alarming means mounted on said upper cover of FIG. 3A.

FIGS. 3A through 3C more clearly show the upper cover B of the stowage framework A which is adapted to be positioned in the upper portion of the slab opening 4. The upper cover B includes a base plate 20, a plurality of suitably spaced pivot arms 22 secured at one end to the undersurface of the plate at one end edge thereof and each having a loop at the other or free end and a pivot shaft 11 extending through the loop at the other end of each of the arms 22. The pivot arms 22 are fitted in the openings defined by the corresponding pivot support arms (not shown) provided in suitable positions of the framework A and having openings in alignment with the loops in the arms 22. The pivot shafts 11 also extend through the aligned openings in the pivot support arms on the framework A. The upper cover B further includes a handle 23 on the upper surface of the base plate 20 by means of which the user can pivot the upper cover B upwardly about the shafts 11 to the substantially upright position and spaced and parallel transverse handholds 24 on the upper surface of the plate 20 by means of which the user can rapidly move onto the escape means E when the upper cover B is fully opened to the substantially upright position.

Figure 1D:
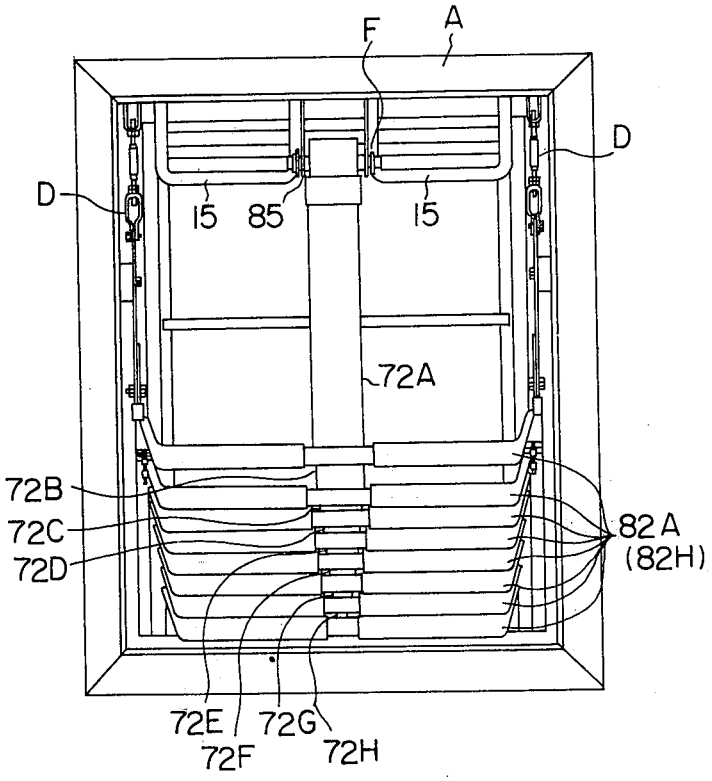
FIG. 1D is a plan view on an enlarged scale of said escape as shown in FIG. 1A showing the escape in its non-operative or collapsed condition with the upper cover removed therefrom.

As shown in FIG. 1D, the inner surface of one of the side wall members 1 (the side wall member positioned adjacent to the end edge of the upper cover where the pivot arms 22 are provided) is provided with a pair of laterally spaced and aligned footholds 15 which cooperate with the handholds 24 for assisting the user in transferring to the escape means E.

The upper cover B has an alarming means 27 mounted on the undersurface of the base plate 20 as shown in FIG. 3C and the alarming means includes a buzzer 25 adapted to give an alarm to the occupants in the particular storey of a building of occurrence of any emergency such as fire and an illumination light 26 adapted to lighten the position of the escape means E and also the environmental area of the escape means to indicate whether the upper and lower covers B and C have been opened or not.

The upper cover B further includes a plurality of longitudinal and transverse reinforcing members 28 integrally attached to the undersurface thereof so that the cover can be prevented from deforming or ditorting during its use. Furthermore, the base plate 20 of the upper cover B has an instruction label 29 secured to the undersurface thereof by means of adhesive and the label bears informations relating to manipulation of the escape means and the like so that the user can leave the particular storey where a fire took place safely and rapidly by the use of the escape means E.

Figure 4C:
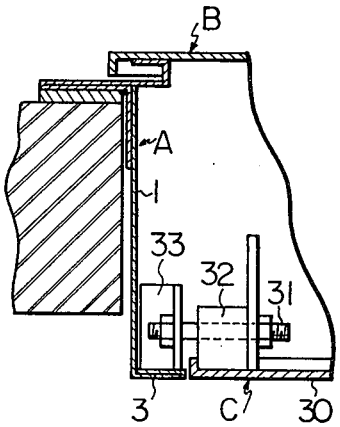
FIG. 4C is a fragmentary cross-sectional view especially showing the pivot support arrangement for said lower cover of FIG. 4A.
Figure 4A:
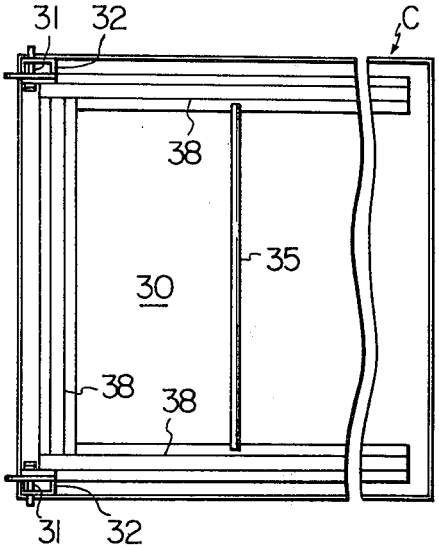
FIG. 4A is a reverse side view on an enlarged scale of a preferred form of lower cover for use in connection with said stowage framework of FIG. 2A with a portion of the cover cut away.
Figure 4B:
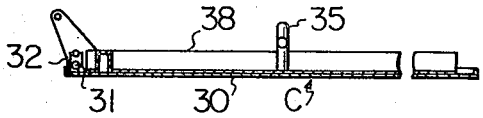
FIG. 4B is a side elevational view in longitudinal section of said lower cover of FIG. 4A.

FIGS. 4A through 4C show details of the lower cover C of the stowage framework A which is to be pivoted to the opening 4 on the ceiling side of the lower storey of the adjacent two storeies of a building. The lower cover C includes a base plate 30, a plurality of suitably spaced pivot arms 32 secured to the upper surface of the plate at one end edge thereof corresponding to the pivot arms 22 associated with the upper cover B in position and number, respectively and pivot shafts 31 extending through the respectively associated pivot arms 32 and received at one end in pivotal support arms 33 on the stowage framework A for pivotally support the lower cover C on the framework A.

The upper surface of the lower cover C is also provided in a suitable position with an upholding member 35 on which the escape means E rests in its substantially horizontal collapsed position and reinforcing members 38 for preventing the lower cover C from deforming or distorting during its use.

As more clearly shown in FIG. 5A, the upper and lower covers B and C are connected to each other in an interlocking relationship by means of a plurality of linkage means D for relative movement to each other. The linkage means D are positioned on the opposite sides of the upper and lower covers B and C and so arranged that when the linkage means D are pivoted from the position shown in FIG. 5A to the position shown in FIG. 1B, the upper cover B is pivoted to substantially the upright position and held in position and at the same time, the lower cover C is pivoted to the suspending position substantially at right angles to the framework A.

Since the pair of linkage means D are identical with each other, only one of the linkage means will be described referring to FIGS. 5B through 5G. As shown in these Figures, the linkage means D includes a link 41 eccentrically pivoted at a position more closer to the pivot points 11 and 31 of the covers to the inner surface of the associated one side wall member 1 of the framework A by means of a pivot pin 42, an arm 45 having one end pivoted by means of a pivot pin 44 to a bracket 43 integrally attached to the upper cover B and the other end pivoted to one end of the link 41 and a substantially threaded bar 51 having the opposite reduced diamiter threaded ends on one of which an internally threaded connector 48A is threaded and on the other end of which a similar internally threaded connector 48B is threaded. The other end of the connector 48A is pivoted by means of a pivot pin 49 to an operation arm 47 which is in turn pivoted at the other end to the associated pivot shaft 31 on the lower cover C and the other end of the connector 48B is pivoted to the other end of the link 41 by means of a pivot shaft 50.

When the upper and lower covers B and C are in their non-operative or closed position as shown in FIG. 5B, in the lower cover C, the combined weight W of both the cover C itself and the escape means E supported on the cover acts as a certain magnitude of clockwise direction moment T on the pivot shafts 31 associated with the lower cover C as seen in FIG. 5B. The moment T can be expressed as:

where $$T = W \times L$$

T: moment on the pivot shaft 31

W: combined weight of the lower cover C and escape means E thereon

L: distance between the center of the pivot shaft 31 and the gravity center of the lower cover C and escape means E Similarly, the weight $W_1$ of the upper cover B provides a certain magnitude of clockwise direction moment $T_1$ to the pivot shafts 11 associated with the upper cover B as seen in FIG. 5B.

The moment $T_1$ can be expressed as:

where $$T_1 = W_1 \times L_1$$

$T_1$: moment on the pivot shaft 11

$W_1$: weight of the upper cover B $L_1$: distance between the center of the pivot shaft 11 and the gravity center of the upper cover B Furthermore, in addition to the weight of the upper cover B, the pivot shafts 11 associated with the upper cover B is subjected to the moment T acting on the lower cover C as a component of force $F_1$ through the operation arms 47, threaded bars 51, links 41, arms 45, pivot shafts 49, 50, 42 and 46 associated with the operation arms 47, threaded bars 51, links 41 and arms 45, respectively and the pivot pins 44 on the arms 45.

Thus, assuming that the pivot point Q of the arm 45 is positioned below the line y which connects between the center O of the pivot shaft 11 and the common pivot point P of the arm 45 and link 41, the pivot shaft 11 is subjected to the clockwise direction moment $M_1$ by the component of force $F_1$ and the moment arm $l_1$ shown by the vertical distance from the center of the pivot shaft 11 to the operation line of the component of force $F_1$ or the distance from the center O of the pivot shaft 11 to the line which connects between the common pivot point P of the link 41 and arm 45 and the pivot point Q of the arm 45 on the upper cover B.

The moment $M_1$ can be expressed as:

where $$M_1 = F_1 \times l_1$$

$M_1$: moment applied on the pivot shaft 11 when the pivot point Q is positioned below the center O of the pivot shaft 11 and the common pivot point P of the link 41 and arm 45

$F_1$: component of force generated at the pivot point Q $l_1$: moment arm provided at the pivot shaft 11

Therefore, when the pivot point Q of the arm 45 is positioned below the center O of the pivot shaft 11 and the common pivot point P of the link 41 and arm 45, the gravity acting on the lower cover C, that is, the clockwise direction moment T acting on the pivot shaft 31 associated with the lower cover C is transmitted as the component of force $F_1$ to the pivot point Q of the arm 45 through the elements 47, 51, 41 and 45 of the linkage means 45. However, this component of force $F_1$ is transmitted to the pivot shaft 11 of the upper cover B as a clockwise direction moment $M_1$ and thus, the pivot shaft 11 is subjected to the combined moment comprising the moment $F_1$ and the moment $T_1$ due to the weight $W_1$ of the upper cover B whereby the lower cover C is firmly maintained in its position for closing the opening in the stowage framework A unless the lower cover C is forced to open or damaged. On the other hand, when the pivot point Q of the arm 45 or the operation line of the component of force $F_1$ is positioned on the line connecting between the center O of the pivot shaft 11 and the common pivot point P of the link 41 and arm 45, as shown in FIG. 5C, the moment arm $l_2$ will be zero and the pivot shaft 11 will not be subjected to the moment $M_2$ in either direction to be maintained in its balanced condition. Thus, $$M_2 = F_1 \times l_2 = 0$$

Therefore, even in the latter case, since the pivot shaft 11 is subjected to the clockwise direction moment $T_1$ due to the own weight $W_1$ of the upper cover B, the lower cover C will be prevented from being inadvertently opened.

Furthermore, when the pivot point Q of the arm 45 or the operation line of the component of force $F_1$ is positioned above the line connecting between the center O of the pivot shaft 11 and the common pivot point P of the link 41 and arm 45, as shown in FIG. 5D, a moment arm $l_3$ is provided at the pivot shaft 11 and the shaft 11 is subjected to a counterclockwise direction moment $M_3$.

The moment $M_3$ can be expressed as:
where $$M_3 = F_1 \times l_3$$

$M_3$: moment at the pivot shaft 11 when the pivot point Q is positioned above the center O of the pivot shaft 11 and the common pivot point P of the link 41 and arm 45

$F_1$: component of force applied at the pivot point Q $l_3$: moment arm provided at the pivot shaft 11

Therefore, even in this case, when the counter-clockwise direction moment $M_3$ due to the component of force $F_1$ and the clockwise direction moment $T_1$ due to the weight of the upper cover B have the relationship $M_3<T_1$, the upper and lower covers B and C will not be forced to open, but in case of $M_3>T_1$, it is not possible to maintain the upper and lower covers B and C in their closed position.

However, even in case of $M_3<T_1$, there is the possibility that a slight external force is applied on the lower cover C to provide a quite unstable condition in which $M_3<T_1$ will easily change to $M_3 = T_1$ or $M_3>T_1$.

Therefore, according to the present invention, the pivot point Q of the arm 45 is preferably positioned at least on or below the line connecting between the center O of the pivot shaft 11 and the common pivot point P of the link 41 and arm 45 and it is also preferably to position the common pivot point P of the link 41 and arm 45 near to the upper cover B as much as possible.

When it is desired to open the upper cover B, the upper cover B is pulled up or pivoted upwardly about the pivots 11, 22 by the handle 23 (FIG. 3A) whereupon the arms 45 are also pivoted upwardly about the pivot shafts 44.

Figure 5E:
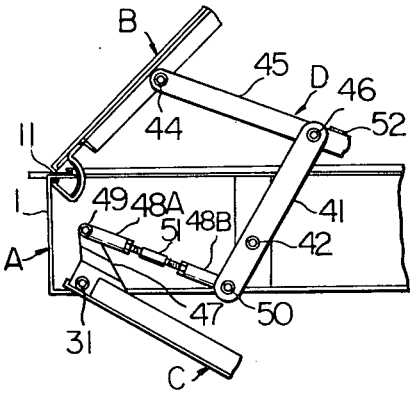
FIG. 5E is a fragmentary side elevational view in longitudinal section of said linkage means as shown in FIG. 5A showing the linkage means in its partially released position together with a portion of said framework.
Figure 5F:
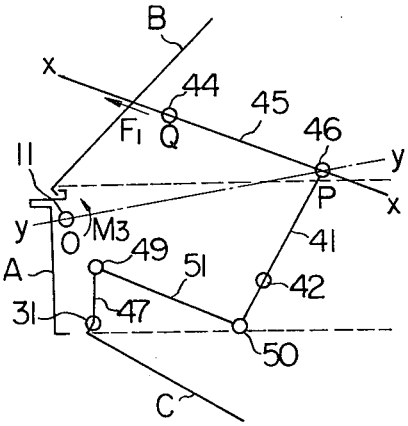
FIG. 5F is a diagramatic view showing the operation of said linkage means in the partially released position corresponding to that as shown in FIG. 5E.

As the upper cover B is opened or pivoted upwardly in the manner mentioned hereinabove, when the pivot points Q of the arms 45 are pivoted upwardly to a position above the line connecting between the center O of the pivot shafts 11 and the common pivot points P of the links 41 and arms 45, that is, when the operation lines from the pivot points Q are positioned above the center O of the pivot shafts 11 (see FIGS. 5E and 5F), the clockwise direction moment provided to the pivot shafts 11 by the component of force $F_1$ transmitted from the lower cover C to the upper cover B changes into a counter-clockwise direction moment or the moment in the same direction as the direction in which the upper cover is pivoted upwardly and thus, after the operation lines of the pivot points Q have been moved to the position as shown in FIGS. 5E and 5F, the opening of the upper cover B is substantially accelerated.

Figure 5G:
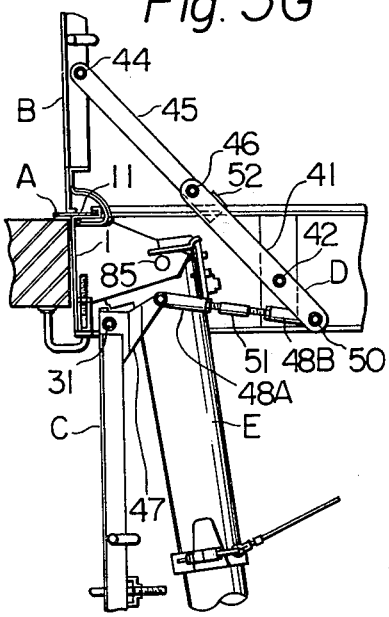
FIG. 5G is a fragmentary side elevational view of said linkage means as shown in FIG. 5A showing the linkage means in its fully released position together with a portion of said framework.
Figure 5K:
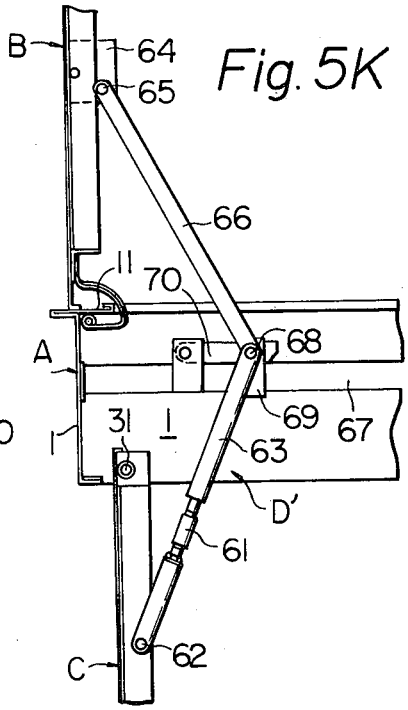
FIGS. 5H, 5I and 5K are fragmentary views showing a modified form of linkage means of the invention in diagramatic and in partial section, respectively.
Figure 5H:
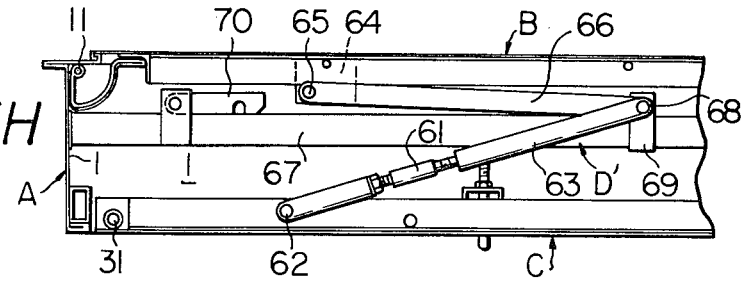
Figure 5I:
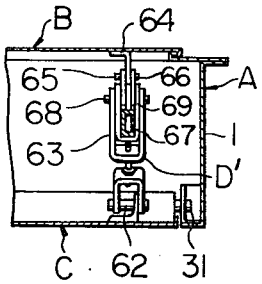

As the upper cover B is pivoted upwardly in the manner as mentioned hereinabove, when the links 41 and arms 45 lie substantially in the same straight plane or the upper and lower covers B and C lie substantially in vertical planes, the stops 52 at one or the right-hand end of the arms 45 as seen in FIGS. 5E and 5G arrest the opening movement of the upper cover B to hold the upper and lower covers B and C in the vertical position (see FIG. 5G).

In response to the opening movement of the upper cover B, the links 41 and threaded bars 51 of the linkage means D are caused to pivot about their associated pivot points to open the lower cover C to its substantially vertical position as mentioned hereinabove whereupon the escape means E is released to thereby allow the pipe sections 72A through 72H to telescopically extend downwardly.

In order to retract or collapse the extended escape means E into the stowage framework A, a downwardly directed force is applied on the arms 45 to disengage the stops 52 on the arms 45 from the common pivot shafts 46 of the links 41 and arms 45 so as to fold the links 41 and 45 which now extend in the straight configuration to each other to thereby pivot the upper cover B back in the closing direction about the pivot shafts 11. The downwardly directed force which forces the upper cover B to pivot back in the closing direction is transmitted through the arms 45, links 41, threaded bars 51 and operation arms 47 to the lower cover C which is then pivoted upwardly or back in the closing direction about the pivot shafts 31.

During the initial stage of the closing operation of the upper and lower covers B and C, since the weight of the escape means acts as a clockwise direction moment or lower cover opening direction moment on the lower cover C and also acts as a component of force in the counter-clockwise direction or upper cover opening direction moment on the upper cover B, the downwardly directed force acting on the upper cover B should be substantially great. As the upper cover B is closed against the upper cover opening moment, the moment diminishes gradually until the center O of the pivot shafts 11, the pivot points Q of the arms 45 and the common pivot points P of the links 41 and arms 45 lie substantially in the same horizontal plane (see FIG. 5C) whereupon the moment is offsetted by the component of force transmitted from the lower cover C to maintain the upper and lower covers B and C in the substantially closed position.

Especially when the upper and lower covers are closed, in the upper cover B, the pivot points Q are positioned lower than the center O and pivot points P (as seen in FIG. A), since the component of force on the lower cover C acts as a clockwise direction moment on the pivot shafts 11 as mentioned hereinabove, after the upper cover B has been pivoted in the closing direction by a small amount, the upper and lower covers B and C can be then automatically pivoted in the closing direction without requiring any additional manual force.

By suitably selecting the length of the arm 45, link 41 and threaded bar 51 and pivotal mounting position in each of the linkage means D, the opening angle of the covers and the force required for opening the covers can be varied as desired.

FIGS. 5H through 5K show a further modified form of linkage means D′ and the linkage means D′ includes a link 63 having an adjusting rod 61 in a substantially midpoint between the opposite ends with one end pivoted to the lower cover C by means of a pivot shaft 62 adjacent to the associated pivot shaft 31, an arm 66 having one end pivoted by means of a pivot pin 65 to a bracket 64 secured to the upper cover B and a slider 69 slidably fitted on a guide member 67 provided on one of the side wall members 1 forming the stowage framework A and pivoted to the other ends of the link 63 and arm 66 by means of a pivot pin 68.

Figure 5J:
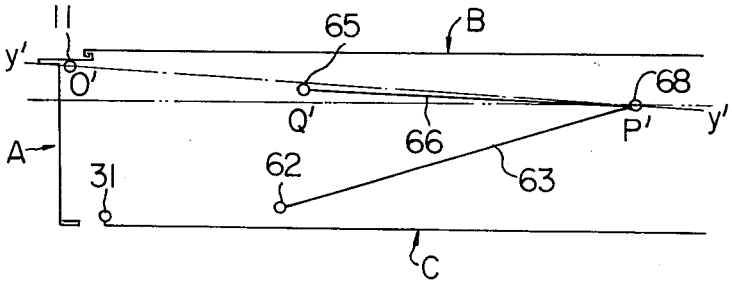
FIG. 5J is a diagramatic view showing said linkage means shown in FIG. 5H.

As in the case of the linkage means D as shown in FIG. 5A, in the escape stowage position, the relationship between the center O′ of the pivot shaft 11, the pivot point Q′ of the arm 66 on the upper cover B and the common pivot point P′ of the arm 66 and link 68 is preferably positioned as shown in FIG. 5J, that is, the pivot point Q′ of the arm 66 is preferably positioned on or lower than the line ($y'$, $y'$) connecting between the center O′ of the pivot shaft 11 and the common pivot point P′ of the arm 66 and link 63.

Now, the operation of the linkage means D′ in opening the upper and lower covers will be described. When the upper cover B is opened, the lower cover C is also opened through the linkage means D′. As the upper cover B is opened, the slider 69 to which the link 63 and arm 66 are pivoted slides along the guide member 67 toward the rotary shaft 11 to pivot the link 63 and arm 66 in the upper cover opening direction about the pivot points 62, 64. When the upper cover B is pivoted to the fully open position or substantially upright position, the stopper 70 pivoted by a pivot pin on a bracket secured to the guide member 67 engages the common pivot pin 68 of the link 63 and arm 66 to arrest the slidable movement of the slider 69 to thereby the opening movement of the upper cover B is stopped and the upper cover is held in position.

In the closing of the upper and lower covers B and C, the stopper 70 is disengaged from the pivot shaft 68 on which the link 63 and arm 66 are pivoted and a downwardly directed force is applied on the upper cover B to pivot the cover in the closing direction about the pivot shaft 11.

In the cover opening and closing operation, the action of the linkage means D′ is the same as described in connection with the linkage means D of FIGS. 5B, 5C and 5D and description of the action of the linkage means D′ will be omitted herein.

FIGS. 6A through 6E show the escape means E of the escape of the invention more clearly. The escape means E comprises eight pipe sections 72A, 72B . . . 72H of substantially oval cross-section having different cross-section areas which are telescopically connected to each other and reduce the cross-section area downwardly in succession. Each of the pipe sections 72A, 72B . . . 72H has four circumferentially spaced raised portions 74 in the outer periphery at the upper end of the pipe section and the corresponding number of similarly spaced raised portions 76 in the inner periphery at the lower end of the associated pipe section, respectively. The inner periphery of each of the pipe sections 72 is recessed in portions corresponding to the raised portions 74 and similarly, the outer periphery of the pipe section is recessed in portions corresponding to the raised portions 76, respectively for the purpose to be described hereinafter. The lower end of each of the raised portions 74 is formed with a wedge-shape as shown by 73 and similarly, the upper end of each of the raised portions 76 is formed with a corresponding wedge-shape as shown by 75. With the above construction of the pipe sections 72, each of the pipe sections is telescopically received within the adjacent upper larger pipe section. In extending the escape means E comprising the telescopically connected pipe sections 72A, 72B . . . 72H, the wedge-shaped lower end 73 of the raised portion 74 on each pipe section engages in the correspondingly shaped upper end 75 of the raised portion 76 in the adjacent or upper larger pipe section whereby the upper pipe section suspends the lower pipe section therefrom (see FIG. 6C).

Figure 6A:
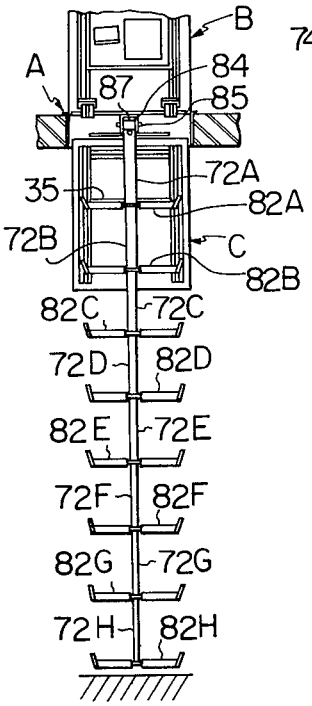
FIG. 6A is a front elevational view of a preferred embodiment of extensible emergency escape means or ladder of the invention.
Figure 6B:
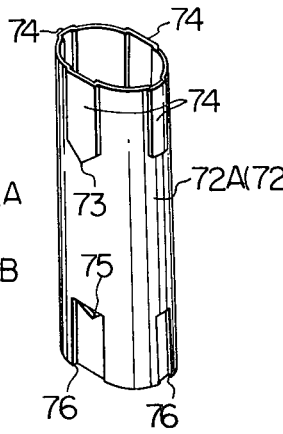
FIG. 6B is a perspective view on an enlarged scale of one of a plurality of pipe sections forming said escape means or ladder as shown in FIG. 6A.
Figure 6C:
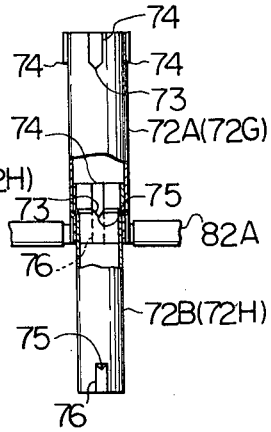
FIG. 6C is a fragmentary view in partially vertical section of the connection arrangement between adjacent pipe sections in said escape means of FIG. 6A.
Figure 6D:
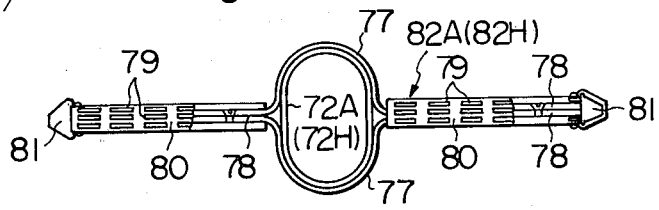
FIG. 6D is a plan view of the rung associated with one of a plurality of pipe sections in said escape means as shown in FIG. 6A.

The pipe sections 72A, 72B . . . 72H have at the lower ends transverse rungs 82A, 82B . . . 82H, respectively (see FIG. 6D).

Each of the rungs 82A, 82B . . . 82H comprises a pair of rung means each including a center semi-circular anchoring portion 77 fastening about substantially one half of the periphery of the associated pipe sections 72A, 72B . . . 72H at the bottom thereof and a pair of rung members 78, 78 extending outwardly from the opposite sides of the center anchoring portion 77. The adjacent rung members 78, 78 of the pair of rung means are connected together by means of screws to thereby anchor the thus formed rung to the associated pipe section. The rungs of the respective pipe sections 72A, 72B . . . 72H are shown by numerals 82A, 82B . . . 82H, respectively in FIG. 6A.

Figure 6E:
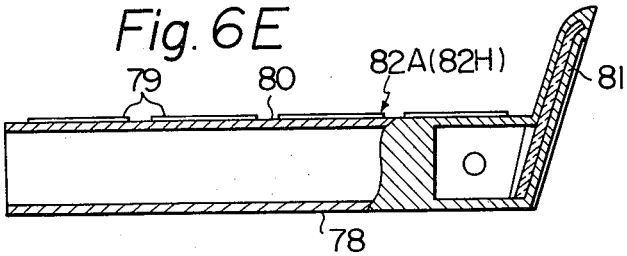
FIG. 6E is a fragmentary longitudinal sectional view on an enlarged scale of said rung as shown in FIG. 6D with a portion thereof removed therefrom.

Each of the rungs 82A, 82B . . . 82H is formed of a resilient material and covered with a non-skid member 80 having the rugged surface 79 thereon and a pair of foot engaging projections 81 are provided at the opposite ends each of the rungs 82A, 82B . . . 82H (see FIGS. 6D and 6E).

In the foregoing, although description has been made of the embodiment of escape means E which comprises eight telescopically connected pipe sections 72A, 72B . . . 72H, the number of such telescopically connected pipe sections 72A, 72B . . . 72H is preferably varied within the range of six to twelve pipe sections depending upon the height of upper and lower storeies in a particular building where the escape of the invention is to be installed without departing the spirit of the invention. As shown in FIG. 6A, since the uppermost pipe section 72A of the escape means E is supported in a suspending relationship in the stowage framework A so that the particular pipe section can rotate about the support shaft 85 journalled in a bracket 84 suitably secured to the side wall members 1 of the stowage framework A, in order to retract the escape means E from its extended position, the upper and lower covers B and C are pivoted to the closing position to telescopically retract the successive lower pipe sections 72B, 72C . . . 72H into their respective upper pipe sections 72A, 72B . . . 72G and the collapsed pipe section assembly is rotated about the shaft 85 to be positioned onto the escape means upholding member 35 (see FIG. 1C and 1D) and storaged within the framework A with the upper and lower covers held in the closing position.

When the collapsed escape means E is desired to be employed for its intended purpose, the upper cover B is released and the release of the upper cover automatically opens the lower cover C through the interlocking function of the linkage means arrangement as mentioned hereinabove. As the lower cover C is opened, the escape means E is rotated about the support shaft 85 to be suspended from the shaft 85. After it has been ascertained that no person is present in the lower storey below the escape, a descent control means F on the uppermost pipe section 72 is released whereby the successive pipe sections telescopically extend to provide an evacuation passage to or adjacent to the floor surface of the lower storey. In order to protect the user from possible hazard, the upper end of the uppermost pipe section 72A is covered with a rubber cap 87.

Furthermore, as seen from FIG. 1B, a wire rope 88 extends and is anchored to the uppermost pipe section 72A and one of the side wall members 1 of the stowage framework A so that the wire rope restrains the extended escape means E from swaying laterally and at the same time, disposes the escape means E at a small angle with respect to the vertical to thereby accelerate the descent of the user along the escape.

The descent control means F is provided at the upper end of the uppermost pipe section 72A as shown in FIGS. 7A through 7D and serves to releasably anchor the escape means E comprising the pipe sections 72A, 72B . . . 72H, adjusts the extension speed of the escape means, pulls the escape means up and retracts the escape means in the framework A.

The descent control means F comprises two substantially U-shaped opposite bearing plates 90, 90 having their legs connected together, a threaded drive shaft 91 rotatably supported in the bearing plates, a drun 94 fixedly mounted on the drive shaft 91 within the uppermost pipe section 72A and having an integral brake plate 93 on one side, an eccentric spring seat 98 freely received on the drive shaft 91 on the outer side of the brake plate 93 and having a substantially horse shoe-shaped enlarged skirt 95 and an eccentric boss 96 having a hole 97 bored in the seat 98 remoted from the skirt 95, a nut 100 threaded on the threaded end 99 of the drive shaft 91 and a coiled spring interposed between the brake plate 93 and nut 100.

The nut 100 has a plurality of circumferentially spaced integral projections 102 in the periphery and one of the projections 102 is slidably received within the guide groove 104 in a guide plate 103 secured to the bearing plates 90.

Furthermore, the descent control means F includes a ratchet mechanism 105 which allows the drive shaft 91 to rotate in one direction.

The ratchet mechanism 105 includes a ratchet 106 secured to one end of the drive shaft 91 which extends out of the adjacent bearing plate 90, engaging lever 108 pivoted on a pivot shaft 107 supported in the other bearing plate 90 for engaging with the ratchet 106, a biassing spring 109 engaging the lever 108 at one end and secured at the other end to the support shaft 107 and a locking lever 110 for limiting the rotation of the engaging lever 108.

The locking lever 110 is eccentrically supported on the adjacent bearing plate 90 by means of a pivot shaft 111. Furthermore, as shown in FIG. 7C, the pivot shaft 111 of the locking lever 110 is preferably positioned outside of the straight line extending from the contact point with the engaging lever 108 so that the shaft 111 is eccentrically positioned more nearer to the engaging lever 108 when the shaft 111 rotates.

Figure 7A:
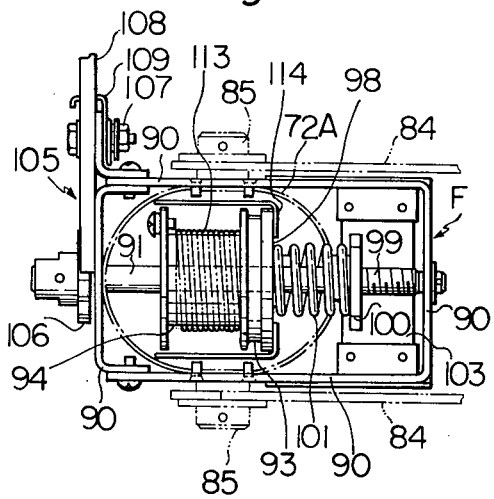
FIG. 7A is a plan view of a preferred form of descent control means employed in said extensible escape as shown in FIG. 1A or FIG. 6A.
Figure 7B:
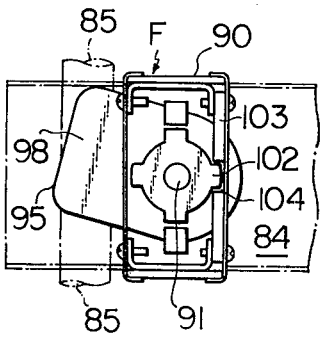
FIG. 7B is a cross-sectional view of the nut and associated parts of said descent control means as shown in FIG. 7A.
Figure 7D:
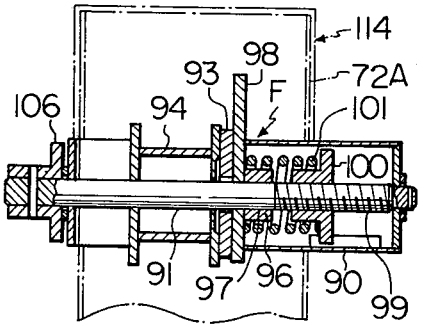
FIG. 7D is a longitudinal sectional view of said descent control means as shown in FIG. 7A.
Figure 7C:
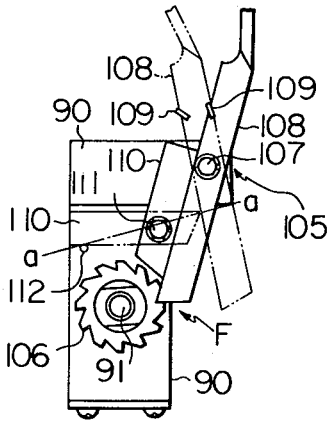
FIG. 7C is an end elevational view of said descent control means as shown in FIG. 7A.

The locking lever 110 urges the engaging lever 108 to rotate so as to disengage the lower end of the lever 108 from the ratchet 106 and then rotates in the counter clockwise direction as seen in FIG. 7C until the lever 111 engages one of the projections 112 on the bearing plate unit 90 to assume a substantially upright position to thereby prevent the now freed engaging lever 108 from pivoting back in the engaging direction.

The drum 94 has a wire rope 113 would thereabout with one end of the wire rope anchored to the drum and the other end of the wire rope 113 extends through the successive pipe sections 72A, 72B . . . 72H and is anchored to the lowermost pipe section 72H. The drum 94 has a pair of flanges 114 on the opposite sides to prevent the wire rope 113 from slipping out of the drum 94.

In the storaged position of the escape means E, the wire rope 113 is held on the drum 94 in its wound condition and the engaging lever 108 of the ratchet mechanism 105 is in meshing with the ratchet 106.

The operation of the descent control means F will be now described. When it is desired to employ the escape, the upper cover B is first opened to thereby open the lower cover C accordingly and in response to the opening of the upper and lower covers B, C, the escape means E rotates about the shaft 85 to be suspended in a substantially vertical position from the shaft 85.

With the escape means E in such position, when the engaging lever 108 is urged to move out of its engaging with the ratchet 106, the escape means E initiates its descent movement by its own weight.

As the escape means E descends in the manner as mentioned hereinabove, the wire rope 113 is payed out of the drum 94 to impart a rotational force to the drive shaft 91.

According to the present invention, the spring seat 98 is so arranged that in order to impart an inertia to the escape means E during the initial stage of the descent of the escape means, the spring seat 98 is allowed to rotate about the shaft 91 by a small amount.

However, after the spring seat 98 has rotated by such a small amount, the spring seat 98 abuts against the inner surface of the uppermost pipe section 72A by its skirt 95 to be stopped thereby.

Since the brake plate 93 is firmly urged against the spring seat 98 under the force of the spring 101 which is held in its compressed condition by the nut 100, the rotation of the drive shaft 91 is constrained whereby the descent speed of the escape means E is controlled.

When the escape means E further descends by its own weight against the control provided by the abutment of the spring seat 98 against the brake plate 93 under the force of the spring 101, as the drive shaft 91 rotates, the nut 100 which has its one projection 102 received in the guide groove 103 is caused to slidably move away from the spring seat 98 to thereby slack the spring 101. As a result, the frictional resistance provided by the spring seat 98 and brake plate 93 decreases gradually and the drive shaft increases its rotational speed gradually to thereby accelerate the descent of the escape means E. As the escape means E further descends, the frictional resistance provided by the brake plate 93 and spring seat 98 disappears to allow the escape means E to descend freely.

While the pipe sections of the freely descending escape means E are telescopically extending, the engaging lever 108 is, of course, maintained out of engagement with the ratchet 106 by the locking lever 110.

When the escape means E is desired to be retracted to the storage position within the framework A, the retractable handle 115 provided on the undersurface of the upper cover B is moved out of its retracted position to the operative position in which the handle engages the adjacent end of the drive shaft 91. The handle 115 is then turned to rotate the drive shaft 91 so as to wind the payed wire rope 113 onto the drum 94 to thereby raise the escape means E up. Thereafter, the engaging lever 108 is pivoted to engage the ratchet 106 to thereby lock the escape means E in its locked position.

FIGS. 8A through 8F show a further modified form of descent control means F'. The descent control means F' includes two substantially U-shaped bearing plates 120, 120 secured to the uppermost pipe section 72A and connected together, a drive shaft 121 journalled in the bearing plates 120, 120, a drum 124 secured to the drive shaft 121 by means of a pin 122 within the uppermost pipe section 72A and having a brake piece 123 integrally attached to one side of the drum, a friction plate 126 freely mounted on the drive shaft 121 on the side of the drum 124 where the brake piece 123 is provided and having an enlarged skirt 125 adjacent to the inner surface of the bearing plate unit 120, 120, a brake lining 131 freely mounted on the drive shaft 121 adjacent to the friction plate 126 and having an integral brake piece 127, a spring 132 interposed between the brake lining 131 and drum 124 for normally urging the lining and drum away from each other, four circumferentially spaced lever abutment members 133 secured to the drive shaft 121 adjacent to the brake lining 131 and four circumferentially spaced levers 137 pivoted to the lever abutment members 133 by means of pivot shafts 136, respectively. Each of the levers 137 has a weight 134 at one end and an eccentric abutment face 135 at the other end adjacent to the brake lining 131. As more clearly shown in FIGS. 8E and 8F, the brake lining 131 is mounted on the drive shaft 121 against inadvertent rotation about the shaft by means of a key way 129 formed in a center boss 130 on the side of the brake lining 131 adjacent to the friction plate 126 and a key 128 formed in the periphery of the drive shaft 121 and engaged in the key way.

The drum 124 has a wire rope 138 wound thereabout and one end of the wire rope is anchored to the drum and the other end extends through the eight pipe sections 72A, 72B . . . 72H and is anchored to the lowermost pipe section 72H.

A ratchet mechanism 105 is secured to the adjacent end of the drive shaft 121 to allow the drive shaft to rotate in one direction. The corresponding parts of the ratchet mechanism 105 are identical with those of the ratchet mechanism of FIGS. 7A through 7D and thus, the parts of the modified ratchet mechanism 105 of FIGS. 8A through F are shown with the same numerals. Description of the modified form of ratchet mechanism of FIGS. 8A through 8F is omitted herein.

In the operation of the modified form of descent control means F', the upper cover B is opened to open the lower cover C accordingly and the escape means E is rotated about the shaft 85 and suspended from the shaft 85.

With the escape means E suspended from the rotary shaft 85, the engaging lever 108 is urged away from or to disengage from the ratchet 106 whereupon the escape means E is allowed to initiate the descent by its own weight.

As the escape means E descends gradually, the wire rope 138 is payed out of the drum 124 to impart a rotational force to the drive shaft 121.

As the drive shaft 121 rotates, the four levers 137 eccentrically pivoted to the corresponding number of lever abutment members 133 secured to the drive shaft 121 are rotated about their respective pivot shafts 136 under the action of centrifugal force to throw the ends having the weights 134 radially and outwardly away from the axis of the drive shaft 121 (in the A direction in FIG. 8E) and also urge the ends 135 of the levers supporting the pivot pins 136 to abut against the brake lining 131 which is in turn urged against the drum 124. When the brake lining 131 is abutted against by the levers 137 in the manner mentioned above to abut against the drum 124, the drum 124 is caused to alide along the drive shaft 121 in the arrow B direction (FIG. 8E) to firmly compress the frction plate 126 between the brake piece 137 on the brake lining 131 and the brake piece 123 on the drum 124 to thereby restrain the rotation of the drive shaft 121. As a result, the gravity descent speed of the escape means E is controlled at a predetermined constant speed until the escape means extends to or adjacent to the floor surface of the lower storey of the adjacent two stories in a building involved.

The condition of the ratchet mechanism 105 of the descent control means F' when the escape means E descends and the manner in which the pipe sections of the escape means are telescopically retracted for storage are identical with those as described in connection with the embodiment of FIGS. 7A and 7D and description thereof will be omitted herein.

Figure 8A:
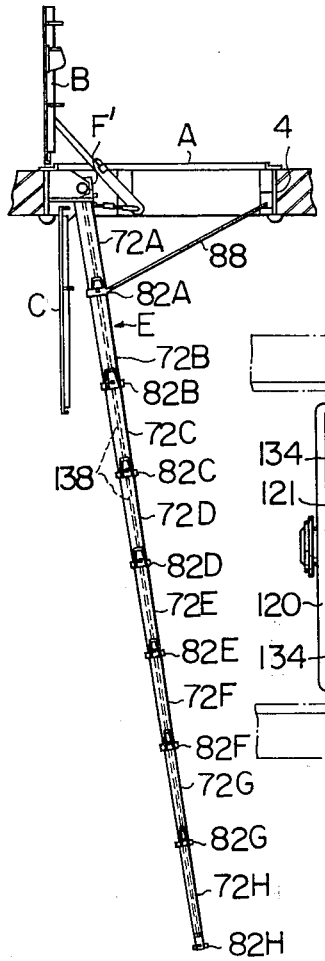
FIG. 8A is a fragmentary cross-sectional view of a modified form of descent control means of the invention as being connected to said escape means.
Figure 8B:
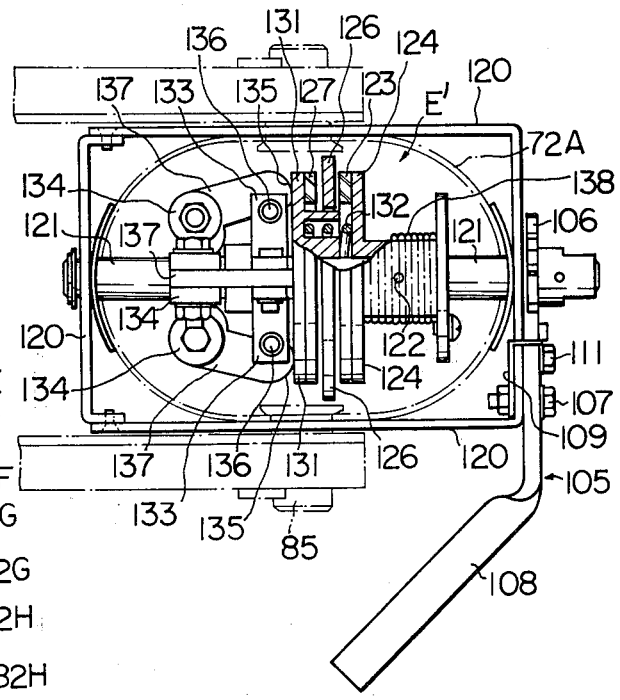
FIG. 8B is a plan view of said descent control means as shown in FIG. 8A.
Figure 8F:
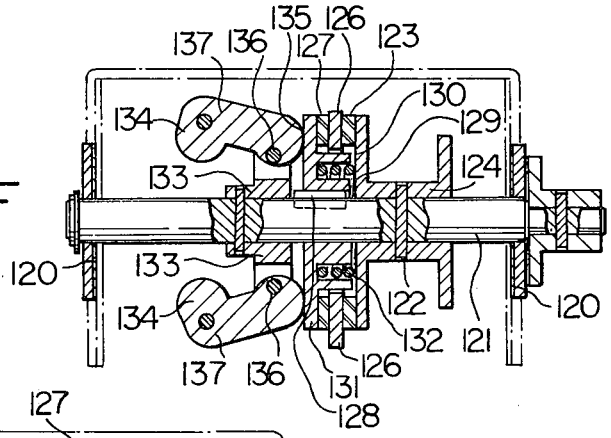
FIG. 8F is a longitudinal sectional view of the descent control means of FIG. 8B with the descent control means operative.
Figure 8G:
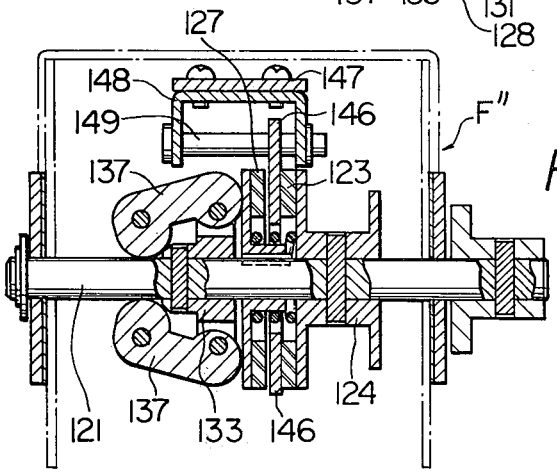
FIGS. 8G and 8H are end and side elevational views in cross-section and longitudinal section, respectively, of a further modified form of descent control means of the invention.
Figure 8H:
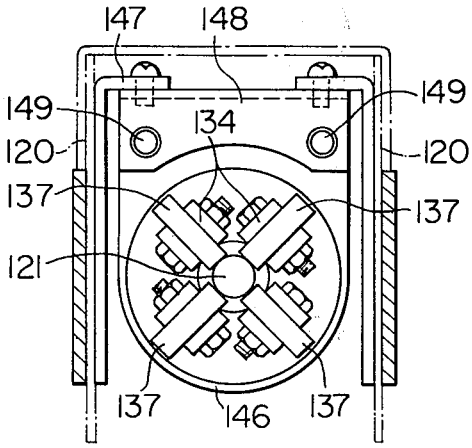

The descent control means F'' of FIGS. 8G and 8H is a further modification of the descent control means F' of FIGS. 8A through 8F. In the embodiment of FIGS. 8G an 8H, the arrangement is so made that the upper portion of a friction plate 146 freely mounted on the drive shaft 121 is slidably received on a pin 149 extending through a guide plate 148 which is in turn secured to the bearing plate unit 120 by means of a bracket 147 and when the friction plate 146 is abutted by brake pieces 123, 127 rotating at a high speed, the friction plate 146 is prevented from inadvertently rotating by the rotational force of the brake pieces.

The corresponding parts of the embodiment of descent control means F'' of FIGS. 8G and 8H are shown by the same numerals denoting the identical parts of the embodiment of descent control means F' and description of the same will be omitted herein.

While preferred embodiments of the invention have been here shown and described, it will be understood that skilled artisans may make minor variations without departing from the spirit of the invention and the scope of the appended claims.

What is claimed is:

1. An emergency escape for use in a building which comprises in combination;

a stowage framework adapted to be anchored in an opening formed in the slab of a floor, veranda or the like of said building;

upper and lower covers pivoted to the floor surface side and ceiling surface side of said framework, respectively;

linkage means pivoted to said upper and lower covers to operatively connect the covers together and open and close the lower cover upon the opening or closing of the upper cover, said linkage means holding said upper cover substantially uprightly when the cover is opened;

telescopically extensible escape means comprising a plurality of telescopically connected pipe sections of different cross-section areas which decrease downwardly, each of said pipe sections having a rung at the lower end and the uppermost pipe section being rotatably supported in said framework whereby when said escape means is storaged in said framework each of the pipe sections is telescopically retracted into the adjacent upper pipe section to be rested on said lower cover and when said upper and lower covers are opened said pipe sections are allowed to telescopically extend to or adjacent to the floor surface of the lower storey of two adjacent stories involved; and descent control means for initiating the descent of said escape means, controlling the extending descent speed of the escape means and pulling the escape means up for stowage upon the closing of said upper and lower covers.

2. The escape for a building according to claim 1, in which said stowage framework includes an outwardly and horizontally bent edge at the upper end and an inwardly and horizontally bent edge at the lower end whereby said stowage framework is held in said opening formed in the slab of a floor or veranda of said building by inserting the framework into the opening, engaging said bent edge at the upper end on the periphery of the opening to suspend the framework from the slab, applying one arm of a U-shaped anchoring rod against the ceiling side surface of said slab about said opening, passing the other threaded arm of said U-shaped anchoring rod through said bent edge at the lower end and fastening a nut on said threaded other end.

3. The escape for a building according to claim 1, in which said stowage framework includes anchoring angles provided on the side wall members which constitute the framework whereby said framework is held in position by securing said anchoring angles to reinforcing steel bars partically embedded in the base of the veranda or the like of said building and placing mortar, concrete or the like about the framework to cover said angles and steel bars.

4. The escape for a building according to claim 1, in which said upper cover includes a cover plate, a plurality of suitably spaced pivot arms secured to the undersurface of said plate at one end thereof and pivot shafts journalled in said pivot arms.

5. The escape for a building according to claim 1, in which said upper cover includes a cover plate, a handle secured to the upper surface of said cover plate, handholds provided on the undersurface of said cover plate by means of which the user can quickly move onto said escape means, a buzzer provided on said undersurface of the cover plate to advise the position of the escape and the fact that said upper cover is open and illumination means for lighten the environment surrounding the escape.

6. The escape for a building according to claim 1, in which said lower cover includes a cover plate, pivot arms provided on the upper surface of said cover plate at one end thereof in positions corresponding to said pivot arms associated with said upper cover and pivot shafts journalled in pivot arms provided on said framework and in said pivot arms associated with the lower cover for pivotally supporting the lower cover in said stowage framework.

7. The escape for a building according to claim 1, in which said linkage means include links eccentrically pivoted to said framework on the opposite sides of the framework adjacent to said pivot shafts associated with the upper and lower covers, arms pivoted at one end to the undersurface of said upper cover and at the other end to the other end of said links, and threaded bars each having at one end a threadedly received connector pivoted to the associated operation arm pivoted to one of said pivot shafts on the upper surface of said lower cover and at the other end a similar threadedly received connector pivoted to the other end of the associated link.

8. The escape for a building according to claim 7, in which each of said linkage means is so arranged that the pivot point of the arm at said upper cover is positioned on or below a straight line connecting between the common pivot point of said link and the other end of the arm and the center of the associated pivot shaft.

9. The escape for a building according to claim 1, in which each of said linkage means includes a link provided with a substantially centrally positioned adjusting rod and having one end pivoted to said lower cover adjacent to said pivot shafts associated with the lower cover, an arm having one end pivoted to a bracket secured to said upper cover and the other end pivoted to the other end of said link, and a slide piece slidably fitted on a guide member provided on the inner surface of the side wall members forming said framework and pivoted to the other end of said arm and link.

10. The escape for a building according to claim 9, in which each of said linkage means is so arranged that the pivot point of said arm on said upper cover is positioned below a straight line connecting between the common pivot point of said link and the other end of the arm and the center of the associated rotary shaft on the upper cover.

11. The escape for a building according to claim 1, in which said escape means comprises a plurality of telescopically slidable pipe sections of different oval cross-section areas which decrease downwardly, each pipe section having on the outer peripheral surface a plurality of circumferentially spaced integral raised portions at the upper end of the pipe section and on the inner peripheral surface a corresponding number of circumferentially spaced raised portions at the lower end of the pipe section for engaging the mating raised portions on the outer peripheral surface of the adjacent lower pipe section whereby when said escape means is extended, the raised portions on the outer periphery of the lower pipe section engage the associated raised portions on the inner periphery of the upper pipe section.

12. The escape for a building according to claim 1, in which said descent control means includes a threaded drive shaft rotatably supported in bearing plates secured to the uppermost pipe section, a drum secured to said drive shaft and having a brake plate integrally attached to one side thereof, an eccentric spring seat positioned on the side of said brake plate opposite from said drum and having an enlarged skirt at one end and the other end eccentrically and freely mounted on said drive shaft, a nut threaded on the threaded end portion of said drive shaft, a spring positioned about said drive shaft between said brake plate and nut.

13. The escape for a building according to claim 1, in which said descent control means comprises a ratchet mechanism including a ratchet secured to one end of said drive shaft, an engaging lever rotatably mounted in said bearing plates by means of a support shaft for engaging with said ratchet, a biassing spring engaging said engaging lever at one end and secured to said support shaft at the other end, and a locking lever for limiting the rotation of said engaging lever.

14. The escape for a building according to claim 1, in which said descent control means includes a drive shaft rotatably supported in bearing plates secured to the uppermost pipe section, a drum secured to said drive shaft and having a brake piece integrally attached to one side thereof, a friction plate freely mounted on said drive shaft adjacent to the inner surface of said bearing plates on the side of said brake piece opposite from said drum and having an enlarged skirt, a brake lining plate slidably mounted on said drive shaft and having a brake piece on the side thereof facing said friction plate, a spring mounted on said drive shaft between said brake lining plate and drum, at least two lever abutments secured to said drive shaft adjacent to said brake lining plate and levers having eccentric brake pieces on the side thereof adjacent to said brake linig plate and eccentrically pivoted to said lever abutments by means of pivot shafts adjacent to said drive shaft.

* * * * *